US006539825B1

(12) United States Patent
Lin

(10) Patent No.: US 6,539,825 B1
(45) Date of Patent: Apr. 1, 2003

(54) SINGLE DIRECTION RATCHETING WRENCH WITH STUCK PREVENTION AND RATCHETING DIRECTION INDICATION

(76) Inventor: Yen-Wen Lin, 13F, No. 27, Lane 93, Liu Yang W. Street, Taichung (TW)

( * ) Notice: Subject to any disclaimer, the term of this patent is extended or adjusted under 35 U.S.C. 154(b) by 30 days.

(21) Appl. No.: 09/957,426

(22) Filed: Sep. 20, 2001

(51) Int. Cl.[7] ..... B25B 13/46
(52) U.S. Cl. ..... 81/60; 192/41 R
(58) Field of Search ..... 81/58, 60, 58.4; 192/41 R

(56) References Cited

U.S. PATENT DOCUMENTS

| | | | |
|---|---|---|---|
| 15,482 | A | 8/1856 | Gilman |
| 810,599 | A | 1/1906 | Ansorge |
| 841,686 | A | 1/1907 | Hatfield |
| 893,097 | A | 7/1908 | Reams |
| 915,446 | A | 3/1909 | Kearnes |
| 1,033,358 | A | 7/1912 | Turner |
| 1,194,471 | A | 8/1916 | Boosinger |
| 1,261,092 | A | 4/1918 | Allen |
| 1,382,492 | A | 6/1921 | Evans |
| 1,426,127 | A | 8/1922 | Tuttle |
| 1,614,039 | A | 1/1927 | Mandl |
| 1,957,462 | A | 5/1934 | Kress |
| 2,193,984 | A | 3/1940 | Rhinevault |
| 2,201,705 | A | 5/1940 | Stone |
| 2,201,827 | A | 5/1940 | Froeschl et al. |
| 2,317,461 | A | 4/1943 | Jackson |
| 2,542,241 | A | 2/1951 | Fors |
| 2,657,604 | A | 11/1953 | Rueb |
| 2,701,977 | A | 2/1955 | Stone |
| 2,764,048 | A | 9/1956 | Thompson |
| 2,769,360 | A | 11/1956 | Cottrell et al. |
| 2,800,821 | A | 7/1957 | Fruscella |
| 2,891,434 | A | 6/1959 | Lozensky |
| 2,957,377 | A | 10/1960 | Hare |

(List continued on next page.)

FOREIGN PATENT DOCUMENTS

| | | |
|---|---|---|
| DE | 921198 | 7/1949 |
| FR | 498276 | 1/1920 |
| GB | 1559093 | 1/1980 |
| GB | 2135226 | 8/1984 |

*Primary Examiner*—James G. Smith
(74) *Attorney, Agent, or Firm*—Alan D. Kamrath; Rider, Bennett, Egan & Arundel

(57) ABSTRACT

A ratcheting wrench comprises a handle and a head extending from the handle. A cavity is defined between a first side and a second side of the handle. A transverse hole is defined in the first side of the handle and communicated with the cavity. A drive member is rotatably mounted in a hole of the head. A block is mounted in the cavity of the handle, and a fixing member extends through the transverse hole of the handle and retains the block in the cavity. A pawl is mounted in the cavity of the handle. An elastic element is attached between the block and the pawl for biasing teeth of the pawl to engage with teeth of the drive member and for biasing the pawl to press against a wall defining the cavity of the handle.

20 Claims, 11 Drawing Sheets

U.S. PATENT DOCUMENTS

| | | | |
|---|---|---|---|
| 2,978,081 | A | 4/1961 | Lundin |
| 3,019,682 | A | 2/1962 | Hare |
| 3,250,157 | A | 5/1966 | Badger |
| 3,265,171 | A | 8/1966 | Kilness |
| 3,337,014 | A | 8/1967 | Sandrick |
| 3,393,587 | A | 7/1968 | Jolliff et al. |
| 3,393,780 | A | 7/1968 | Kilness |
| 3,436,992 | A | 4/1969 | Over et al. |
| 3,577,816 | A | 5/1971 | Alexander et al. |
| 3,713,356 | A | 1/1973 | Knudsen |
| 3,742,788 | A | 7/1973 | Priest |
| 3,838,614 | A | 10/1974 | O'Donnell |
| 3,908,487 | A | 9/1975 | Plaw |
| 4,070,932 | A | 1/1978 | Jeannotte |
| 4,111,077 | A | 9/1978 | Cummings et al. |
| 4,128,025 | A | 12/1978 | Main et al. |
| 4,274,311 | A | 6/1981 | Ebert |
| 4,277,989 | A | 7/1981 | Tracy |
| 4,277,990 | A | 7/1981 | Hall |
| 4,308,768 | A | 1/1982 | Wagner |
| 4,308,769 | A | 1/1982 | Rantanen |
| 4,328,720 | A | 5/1982 | Shiel |
| 4,336,728 | A | 6/1982 | Diebert |
| 4,406,186 | A | 9/1983 | Gummow |
| 4,420,995 | A | 12/1983 | Roberts |
| 4,485,700 | A | 12/1984 | Colvin |
| 4,488,460 | A | 12/1984 | Ballone et al. |
| 4,520,697 | A | 6/1985 | Moetteli |
| 4,631,988 | A | 12/1986 | Colvin |
| 4,662,251 | A | 5/1987 | Kohal |
| 4,709,600 | A | 12/1987 | Mierbach et al. |
| 4,722,252 | A | 2/1988 | Fulcher et al. |
| 4,722,253 | A | 2/1988 | Chow |
| 4,762,033 | A | 8/1988 | Chow |
| 4,770,072 | A | 9/1988 | Neuhaus |
| 4,796,492 | A | 1/1989 | Liou |
| 4,807,500 | A | 2/1989 | Main |
| 4,862,775 | A | 9/1989 | Chow |
| 4,869,138 | A | 9/1989 | Farris |
| 4,903,554 | A | 2/1990 | Colvin |
| 4,934,220 | A | 6/1990 | Slusar et al. |
| 4,986,147 | A | 1/1991 | Cooper |
| 4,991,468 | A | 2/1991 | Lee |
| 5,012,705 | A | 5/1991 | Chow |
| 5,076,121 | A | 12/1991 | Fosella |
| 5,144,869 | A | 9/1992 | Chow |
| 5,157,994 | A | 10/1992 | Krivec |
| 5,178,047 | A | 1/1993 | Arnold et al. |
| 5,199,330 | A | 4/1993 | Arnold et al. |
| 5,199,335 | A | 4/1993 | Arnold et al. |
| 5,230,262 | A | 7/1993 | Ahlund et al. |
| 5,231,903 | A | 8/1993 | Bockman, Jr. |
| 5,233,891 | A | 8/1993 | Arnold et al. |
| 5,271,300 | A | 12/1993 | Zurbuchen et al. |
| 5,295,422 | A | 3/1994 | Chow |
| 5,392,672 | A | 2/1995 | Larson et al. |
| 5,425,291 | A | 6/1995 | Chang |
| 5,467,672 | A | 11/1995 | Ashby |
| 5,477,757 | A | 12/1995 | Maresh |
| 5,495,783 | A | 3/1996 | Slusar et al. |
| 5,499,560 | A | 3/1996 | Aeschliman |
| 5,501,124 | A | 3/1996 | Ashby |
| 5,509,333 | A | 4/1996 | Rion |
| 5,533,427 | A | 7/1996 | Chow |
| 5,557,994 | A | 9/1996 | Nakayama |
| 5,582,081 | A | 12/1996 | Lin |
| 5,595,095 | A | 1/1997 | Hillinger |
| 5,626,061 | A | 5/1997 | Whitley |
| 5,626,062 | A | 5/1997 | Colvin |
| 5,636,557 | A | 6/1997 | Ma |
| 5,709,137 | A | 1/1998 | Blacklock |
| 5,782,147 | A | 7/1998 | Chaconas et al. |
| 5,794,496 | A | 8/1998 | Arnold |
| 5,829,326 | A | 11/1998 | Richner |
| 5,842,391 | A | 12/1998 | Chaconas |
| 5,857,390 | A | 1/1999 | Whiteford |
| 5,873,286 | A | 2/1999 | Van Lenten |
| 5,884,538 | A | 3/1999 | Van Lenten |
| 5,901,620 | A | 5/1999 | Arnold |
| 5,910,197 | A | 6/1999 | Chaconas |
| 5,911,798 | A | 6/1999 | Arnold |
| 5,913,954 | A | 6/1999 | Arnold et al. |
| 5,927,158 | A | 7/1999 | Lin |
| 5,946,987 | A | 9/1999 | Wei |
| 5,946,989 | A | 9/1999 | Hsieh |
| 5,957,009 | A | 9/1999 | McCann |
| 5,964,129 | A | 10/1999 | Shiao |
| 5,970,552 | A | 10/1999 | Kwiecien et al. |
| 5,979,274 | A | 11/1999 | Hsieh |
| 5,996,453 | A | 12/1999 | Blacklock |
| 6,000,302 | A | 12/1999 | Chiang |
| 6,006,631 | A | 12/1999 | Miner et al. |
| 6,044,731 | A | 4/2000 | Hsieh |
| 6,065,374 | A | 5/2000 | Taggart |
| 6,134,990 | A | 10/2000 | Ling et al. |
| 6,134,991 | A | 10/2000 | Chaconas |
| D433,896 | S | 11/2000 | Wei |
| 6,148,695 | A | 11/2000 | Hu |
| 6,152,826 | A | 11/2000 | Profeta et al. |
| 6,161,454 | A | 12/2000 | Chaconas |
| 6,164,167 | A | 12/2000 | Chen |
| 6,205,889 | B1 | 3/2001 | Hsieh |
| 6,209,423 | B1 | 4/2001 | Shiao |
| 6,216,563 | B1 | 4/2001 | Hsieh |
| 6,216,567 | B1 | 4/2001 | Hu |
| 6,220,123 | B1 | 4/2001 | Chen |
| 6,230,591 | B1 | 5/2001 | Ling et al. |
| 6,240,813 | B1 | 6/2001 | Hyatt |
| 6,257,096 | B1 | 7/2001 | Ling |
| 6,260,448 | B1 | 7/2001 | Chaconas |
| 6,263,767 | B1 | 7/2001 | Hu |
| 6,282,991 | B1 | 9/2001 | Hu |
| 6,282,992 | B1 | 9/2001 | Hu |
| 6,282,993 | B1 | 9/2001 | Forman et al. |
| 6,301,998 | B1 | 10/2001 | Hu |
| 6,431,031 | B1 | 8/2002 | Hu |
| 6,435,062 | B1 | 8/2002 | McCann |
| 6,435,063 | B1 | 8/2002 | Chen |
| 6,450,066 | B1 | 9/2002 | Hu |
| 6,450,068 | B1 | 9/2002 | Hu |
| 6,453,779 | B2 | 9/2002 | Hu |
| 6,457,387 | B1 | 10/2002 | Hu |
| 6,457,389 | B1 | 10/2002 | Hu |
| 6,488,136 | B2 | 12/2002 | Chang |
| 2001/0035074 | A1 | 11/2001 | Hu |
| 2002/0017169 | A1 | 2/2002 | Hu |
| 2002/0023519 | A1 | 2/2002 | Hu |
| 2002/0023520 | A1 | 2/2002 | Hu |
| 2002/0026858 | A1 | 3/2002 | Hu |
| 2002/0088312 | A1 | 7/2002 | Ling et al. |
| 2002/0112573 | A1 | 8/2002 | Hu |
| 2002/0162423 | A1 | 11/2002 | Hu |
| 2002/0162424 | A1 | 11/2002 | Hu |
| 2002/0166416 | A1 | 11/2002 | Hu |
| 2002/0166417 | A1 | 11/2002 | Hu |

A-A

B–B

SINGLE DIRECTION RATCHETING WRENCH WITH STUCK PREVENTION AND RATCHETING DIRECTION INDICATION

BACKGROUND OF THE INVENTION

1. Field of the Invention

The present invention relates to a single direction ratcheting wrench with stuck prevention and ratcheting direction indication.

2. Description of the Related Art

FIGS. 9 and 10 of the drawings illustrate a conventional ratcheting wrench that has a single ratcheting direction. The wrench comprises a handle 21 ' and a head 20' extending from the handle 21'. A gear wheel 50' is rotatably mounted in a hole 22' defined in the head 20'. A block 40' and a pawl 30' are mounted in a cavity 23' defined in the handle 21' and communicated with the hole 22' of the head 20'. The block 40' comprises a fulcrum 41' extending from a side and facing a wall 24' defining the cavity 23'. The block 40' further comprises two protrusions 42 that are alternately engaged with the teeth 52' of the gear wheel 50'. Thus, the block 40 keeps swaying but has no displacement. A spring 44' is attached between the block 40' and the pawl 30' to bias the teeth 32' of the pawl 30' to engage with the teeth 52' of the gear wheel 50' and to bias a side 34' of the pawl 30' to press against the wall 24' defining the cavity 23'. Thus, the wrench drives a fastener (not shown) engaged in an inner periphery 51' of the gear wheel 50' when the wrench is moved clockwise and the wrench moves freely when it is turned counterclockwise. However, it was found that the teeth 52' of the gear wheel 50' engaging with the protrusions 42' of the block 40' tends to wear. In addition, when the gear wheel 50' moves counterclockwise, the block 40' without any fixing arrangement moves toward an upper right portion of the cavity 23' until the block 40' is stuck in the cavity 23'. Further, since the block 40' keeps swaying in the cavity 23', the location of the block 40' will affect the swaying angle thereof. It was found that the swaying angle was smaller when the block 40' is placed in the right portion of the cavity 23'. This results in difficulty in the assembly procedure, as there is no reference point for mounting the block 40' in the cavity 23'. Further, the position of the block 40' changes if the wrench is used as a hammer or it is subject to a shock, which would result in malfunction of the block 40'.

SUMMARY OF THE INVENTION

An object of the present invention is to provide a ratcheting wrench that may prevent stuck of the pawl and provide clear indication of the ratcheting direction of the ratcheting wrench.

A ratcheting wrench in accordance with the present invention comprises a handle having a first side, a second side, and a cavity between the first side and the second side. A transverse hole is defined in the first side of the handle and communicated with the cavity. A head extends from the handle and comprises a hole communicated with the cavity. A drive member is rotatably mounted in the hole of the head and comprises a plurality of teeth in an outer periphery thereof. A block is mounted in the cavity of the handle, and a fixing member extends through the transverse hole of the handle and retains the block in the cavity. A pawl is mounted in the cavity of the handle and comprises a first side having a plurality of teeth and a second side. An elastic element is attached between the block and the pawl for biasing the teeth of the pawl to engage with the teeth of the drive member and for biasing the second side of the pawl to press against a wall defining the cavity of the handle.

In an embodiment of the invention, the transverse hole does not extend through the second side of the handle and provides an indication of a ratcheting direction of the wrench. In another embodiment of the invention, the transverse hole extends through the second side of the handle and is not located in a longitudinal axis of the handle to thereby provide an indication of a ratcheting direction of the wrench.

In an embodiment of the invention, the fixing member is a pin having an embossed section that is in frictional engagement with an inner periphery defining the transverse hole of the handle. The block has a vertical hole through which the pin extends.

When the teeth of the pawl are stuck to the teeth of the drive member, free rotation of the drive member causes the pawl to impinge the block to thereby disengage the pawl from the drive member.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
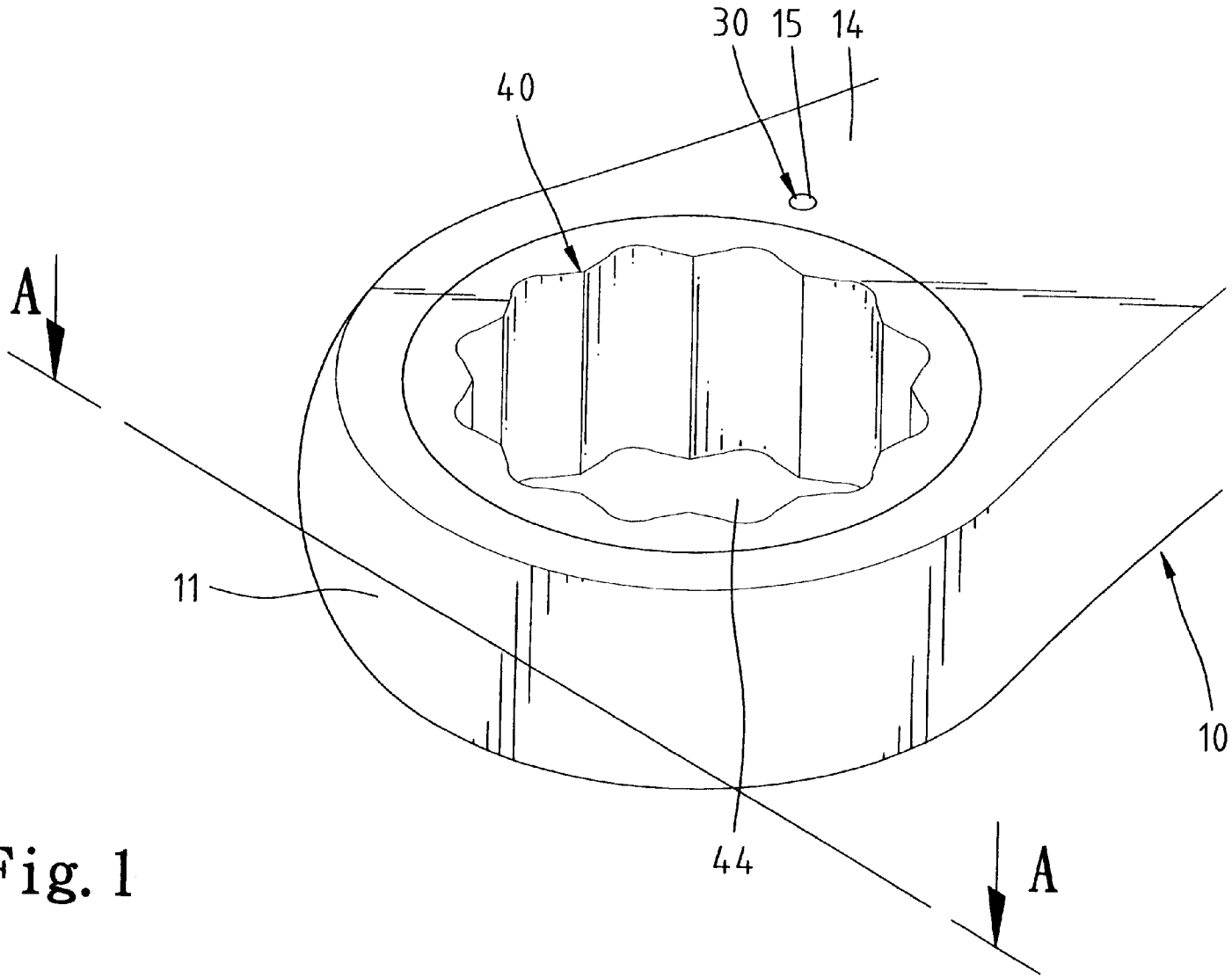
FIG. 1 is a perspective view of an end portion of a ratcheting wrench in accordance with the present invention.
Figure 2:
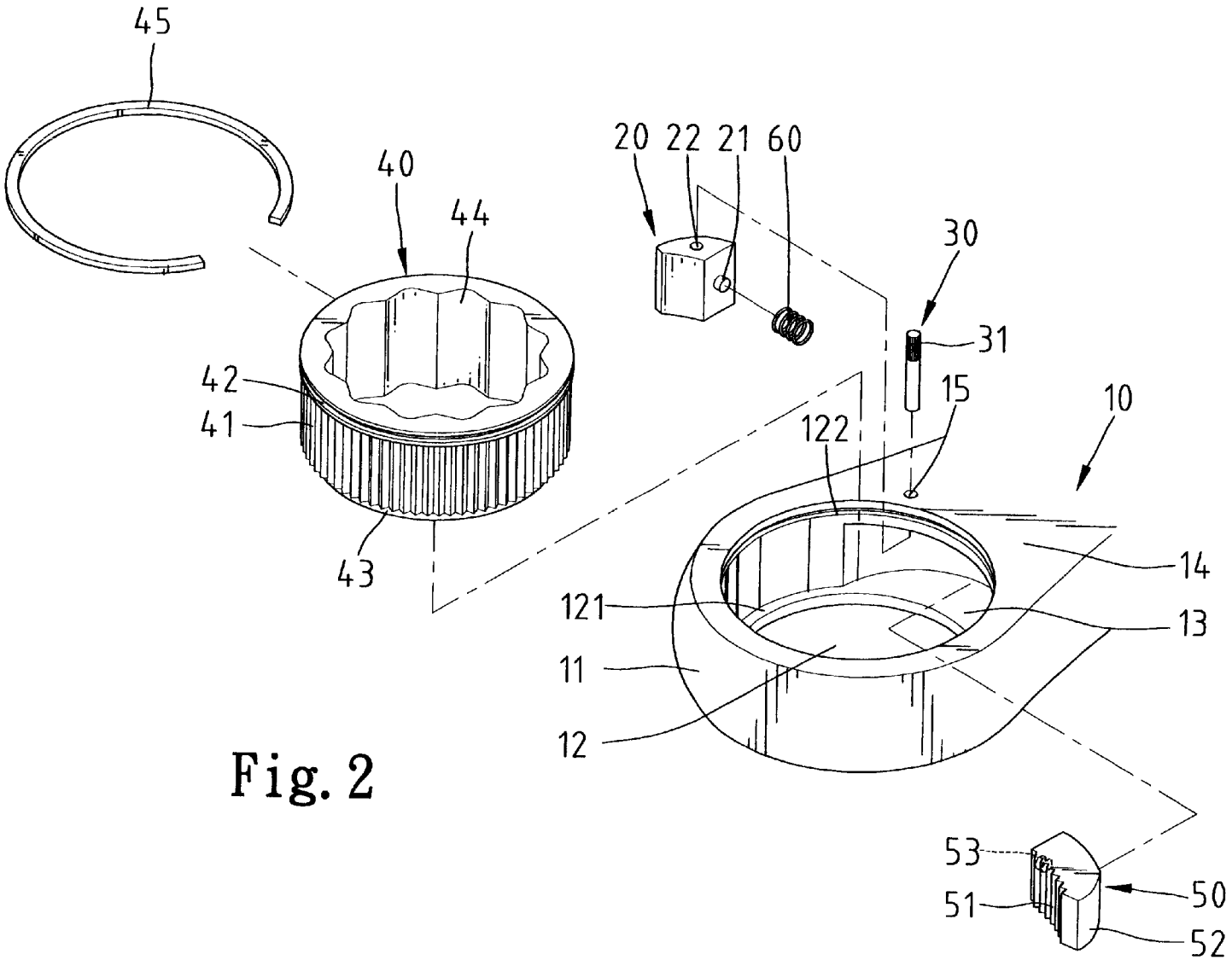
FIG. 2 is an exploded perspective view of the end portion of the ratcheting wrench in accordance with the present invention.

Referring to FIGS. 1 through 9 and initially to FIGS. 1 and 2, a ratcheting wrench in accordance with the present invention generally comprises a handle 10 and a head 11 extending from the handle 10. A hole 12 is defined in the head 11, an annular ledge 121 being formed on an end of an inner periphery defining the hole 12, an annular groove 122 being defined in the other end of the inner periphery defining the hole 12. The handle 10 comprises a first side 14 and a second side 16 (FIG. 6) opposite to the first side 14. A cavity 13 is defined in the handle 10, communicated with the hole 12, and located between the first side 14 and the second side 16 of the handle 10. In this embodiment, a transverse hole 15 extends from the first side 14 and communicates with the cavity 13, but the transverse hole 15 does not extend through the second side 16 of the handle 10.

A drive member (in the form of a gear wheel 40 in this embodiment) is rotatably mounted in the hole 12 of the head 11. The gear wheel 40 comprises a recessed portion 43 in a lower portion thereof for engaging with the annular ledge 121 of the head 11, best shown in FIG. 5. The gear wheel 40 further comprises an annular groove 42 in an upper end thereof, and a C-clip 45 is engaged in the annular groove 42 of the gear wheel 40 and the annular groove 122 in the head 11, thereby allowing rotational movement of the gear wheel 40 in the hole 12 of the head 11. The gear wheel 40 further comprises an inner periphery 44 that is configured to allow easy insertion of a fastener (not shown) to be tightened/loosened. The gear wheel 40 further comprises a plurality of teeth 41 in an outer periphery thereof and located between the annular groove 42 and the recessed portion 43.

Figure 3:
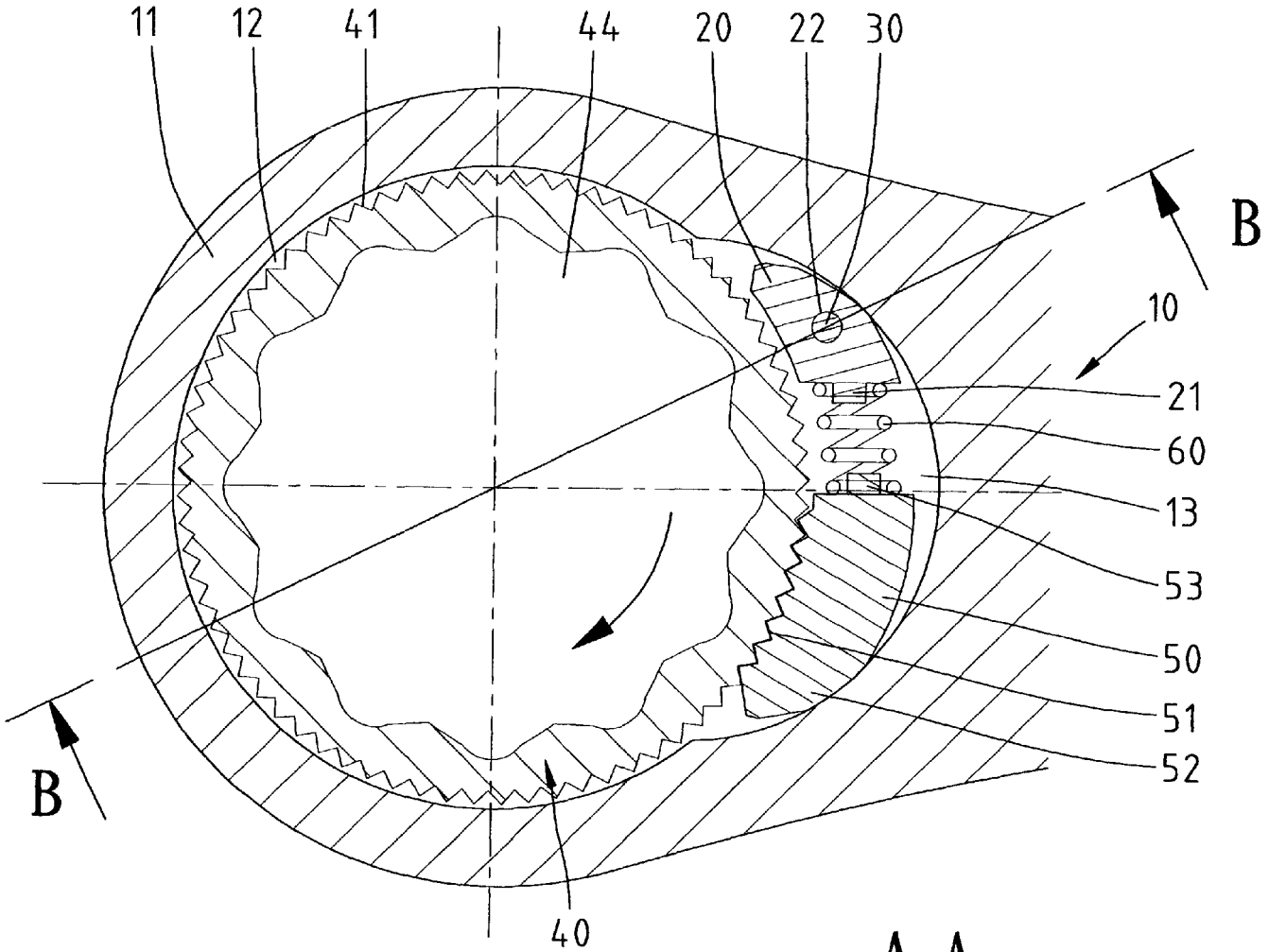
FIG. 3 is a sectional view taken along plane A—A in FIG. 1.

Mounted in the cavity 13 of the handle 10 are a block 20 and a pawl 50. The block 20 comprises a vertical hole 22 and a peg 21 formed on a side thereof. A fixing member (in the form of a pin 30 in this embodiment) extends through the transverse hole 15 of the handle 10 and the vertical hole 22 of the block 20, thereby retaining the block 20 in place. The pin 30 has an embossed section 31 that is in frictional engagement with an inner periphery defining the transverse hole 15 to assure retaining of the block 20. The pawl 50 comprises a first side having a plurality of teeth 51 and an arcuate second side 52 opposite to the first side. A peg 53 is formed on an end of the pawl 50. An elastic element 60 is attached between the peg 21 of the block 20 and the peg 53 of the pawl 50, thereby biasing the teeth 51 of the pawl 50 to engage with the teeth 41 of the gear wheel 40 and to bias the arcuate second side 52 of the pawl 50 to press against the wall defining the cavity 13. Thus, the wrench drives a fastener (not shown) engaged in the inner periphery 44 of the gear wheel 40 when the wrench is moved clockwise and the wrench moves freely when it is turned counterclockwise, as shown in FIG. 3.

Figure 4:
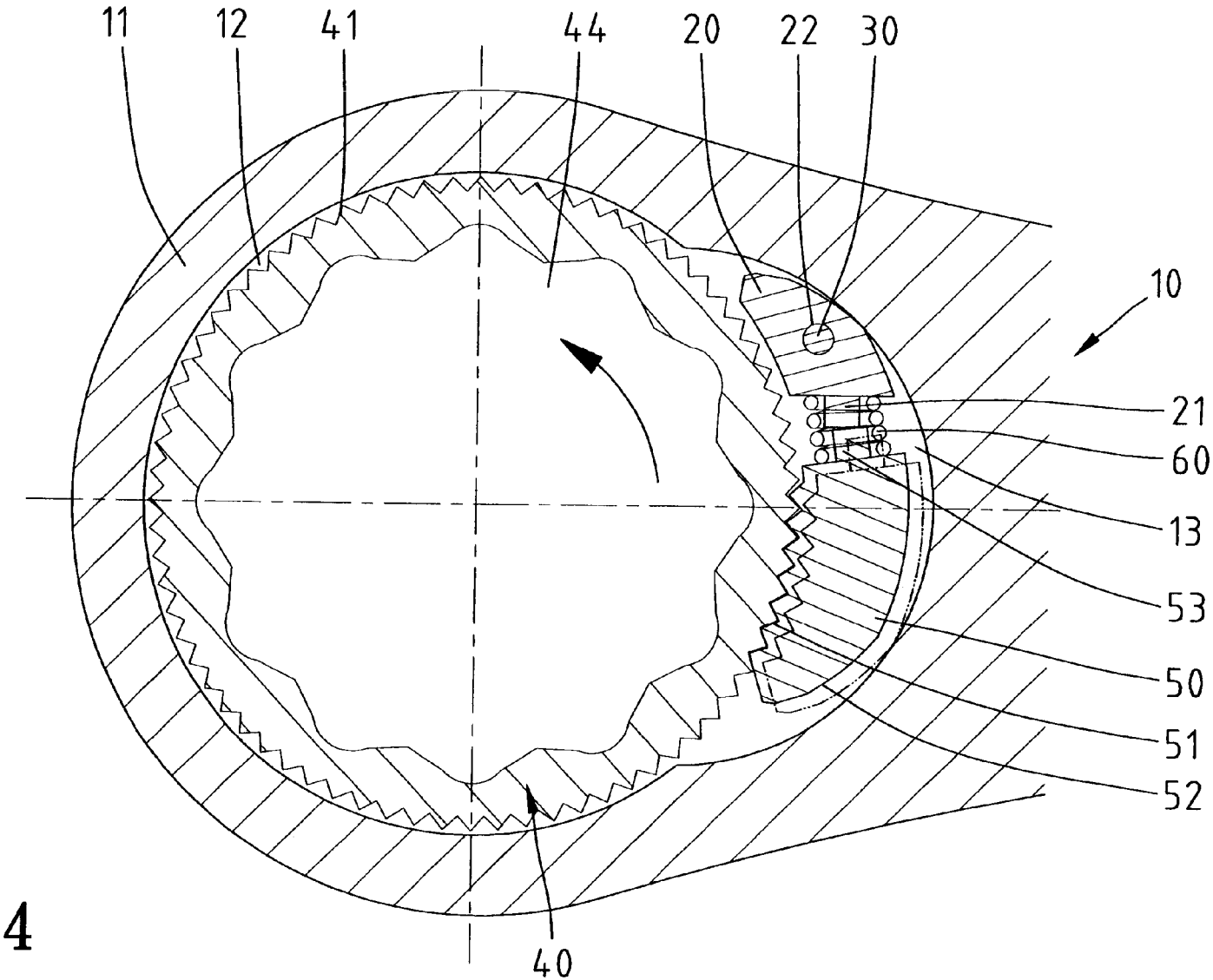
FIG. 4 is a sectional view similar to FIG. 3, illustrating stuck prevention of the ratcheting wrench in accordance with the present invention.
Figure 5:
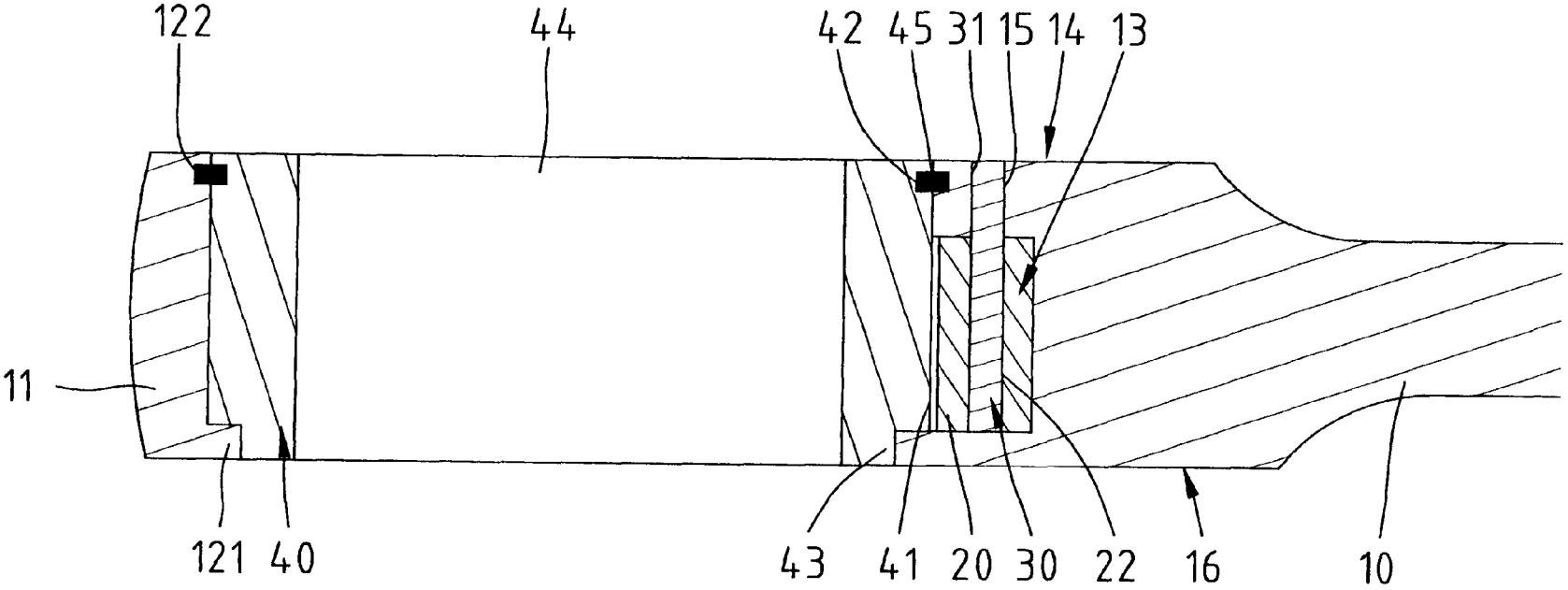
FIG. 5 is a sectional view taken along plane B—B in FIG. 3.

Referring to FIG. 4, when the teeth 51 of the pawl 50 is stuck to the teeth 41 of the gear wheel 40, counterclockwise rotation of the gear wheel 40 moves the pawl 50 (see the solid lines) toward the block 20. The pawl 50 will impinge the block 20 and thus cause disengagement of the pawl 50 from the gear wheel 40 (see the phantom lines) when the pawl 50 is further moved counterclockwise. Thus, the wrench in accordance with the present invention provides a stuck prevention function.

Figure 6A:
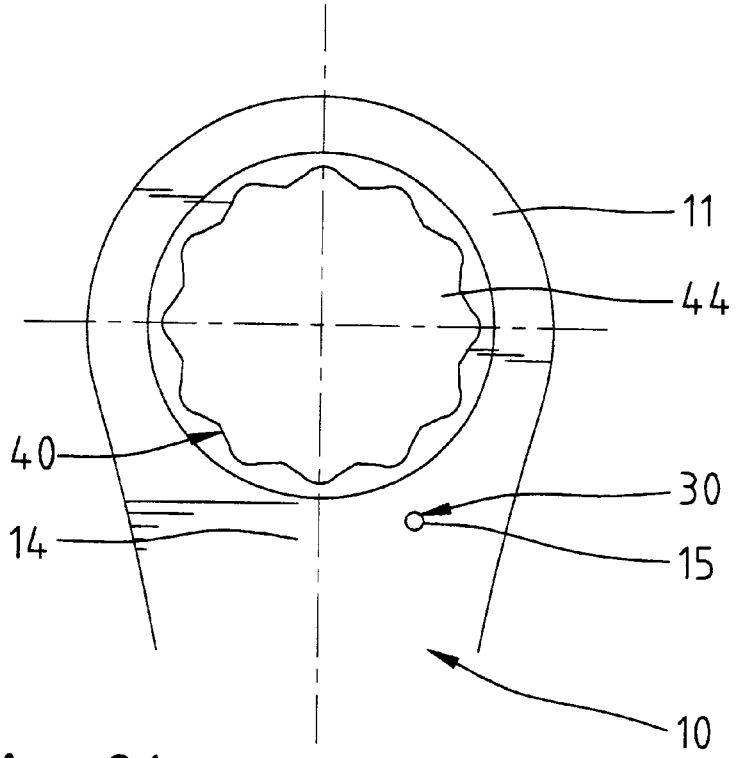
FIG. 6A is a top view of the end portion of the ratcheting wrench in FIG. 1.
Figure 6B:
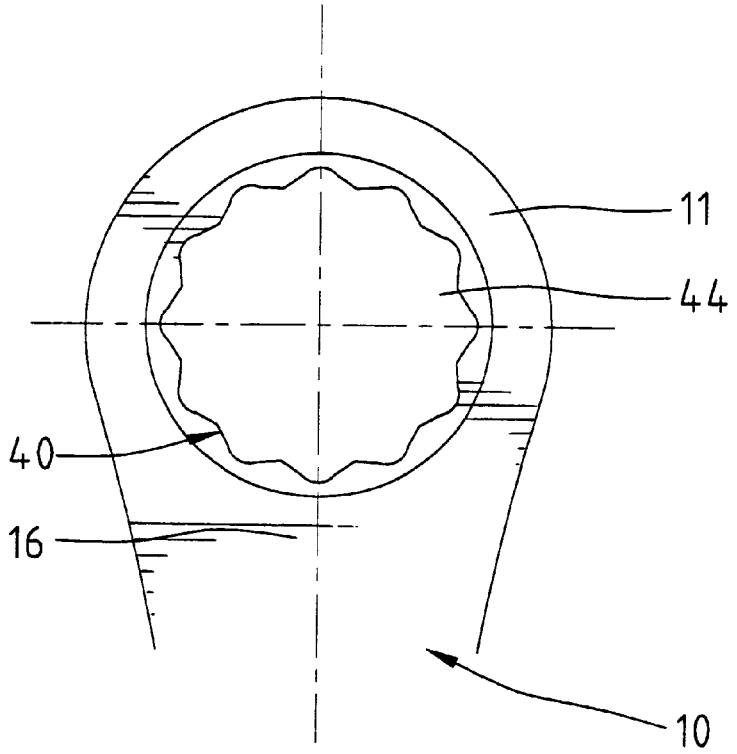
FIG. 6B is a bottom view of the end portion of the ratcheting wrench in FIG. 1.

Referring to FIG. 6A, when the wrench is used in this state, the transverse hole 15 in the first side 14 of the handle 10 faces upward and thus indicates that the wrench can provide clockwise ratcheting and counterclockwise free rotation. Referring to FIG. 6B, when the wrench is used in this state (i.e., the wrench is turned upside-down), there is no hole in the second side 16 of the handle 10 which faces upward, which implies that the wrench can provide counterclockwise ratcheting and clockwise free rotation.

Figure 7:
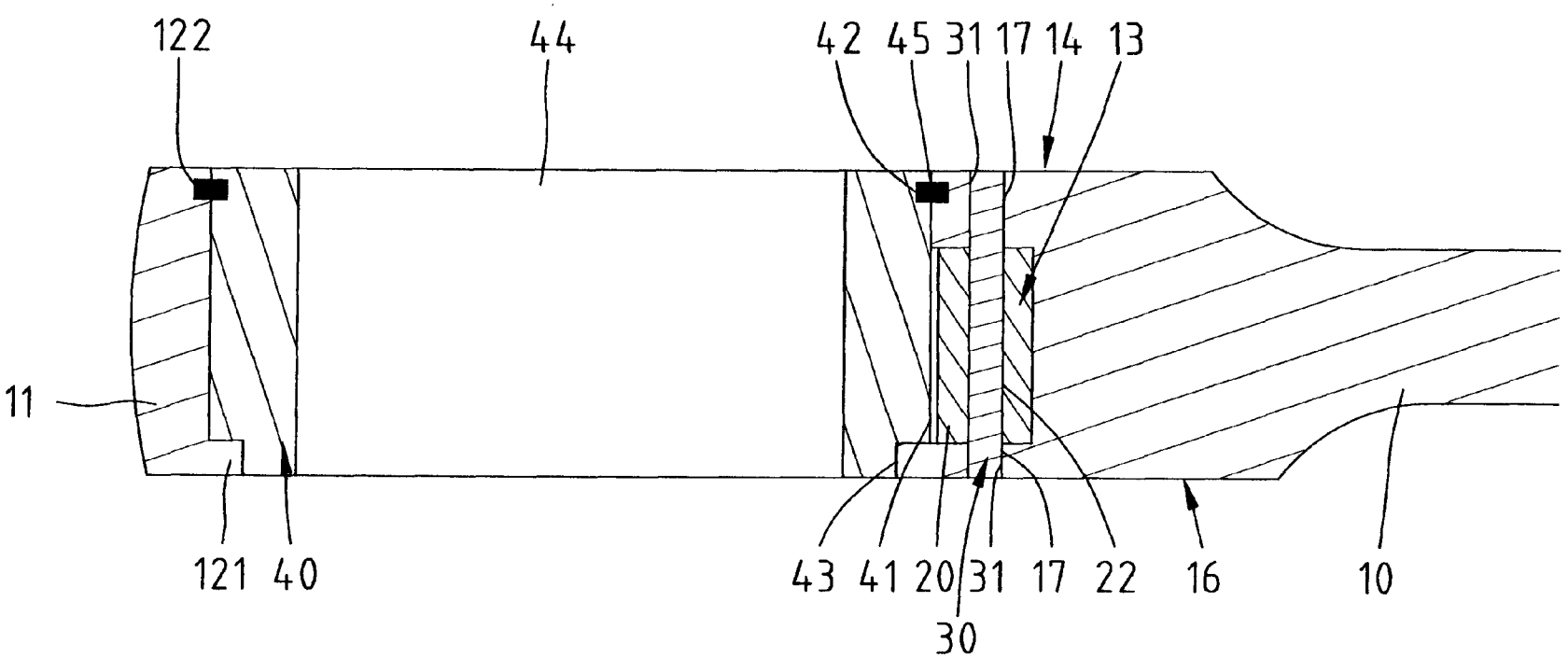
FIG. 7 is a sectional view similar to FIG. 5, illustrating a modified embodiment of the ratcheting wrench in accordance with the present invention.
Figure 8A:
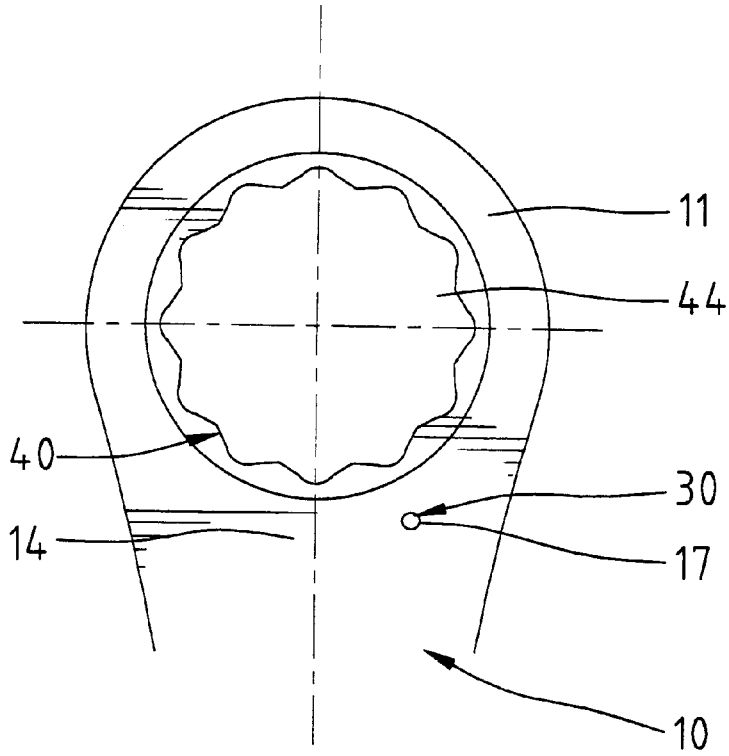
FIG. 8A is a top view of the end portion of the ratcheting wrench in FIG. 7.
Figure 8B:
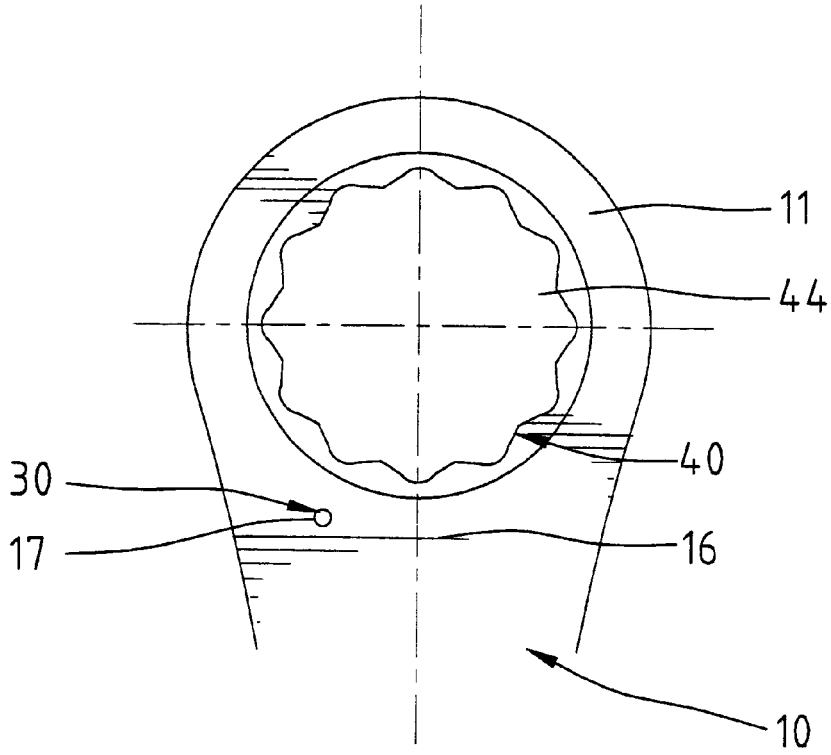
FIG. 8B is a bottom view of the end portion of the ratcheting wrench in FIG. 7.

FIG. 7 illustrates a modified embodiment of the invention, wherein the transverse hole is a through-hole 17 extending from the first side 14 of the handle 10 through the second side 16 of the handle 10. As illustrated in FIG. 8A, an end of the transverse through-hole 17 is located in a non-central position (e.g., the right portion) of the first side 14 of the handle 10 and thus indicates that the wrench can provide clockwise ratcheting and counterclockwise free rotation. Referring to FIG. 8B, when the wrench is turned upside-down, the other end of transverse through-hole 17 is located in the left portion of the second side 16 of the handle 10 and thus indicates that the wrench can provide counterclockwise ratcheting and clockwise free rotation. The term "non-central position" referred to herein means the transverse through-hole 17 is not located in a longitudinal axis of the handle 10.

Figure 9:
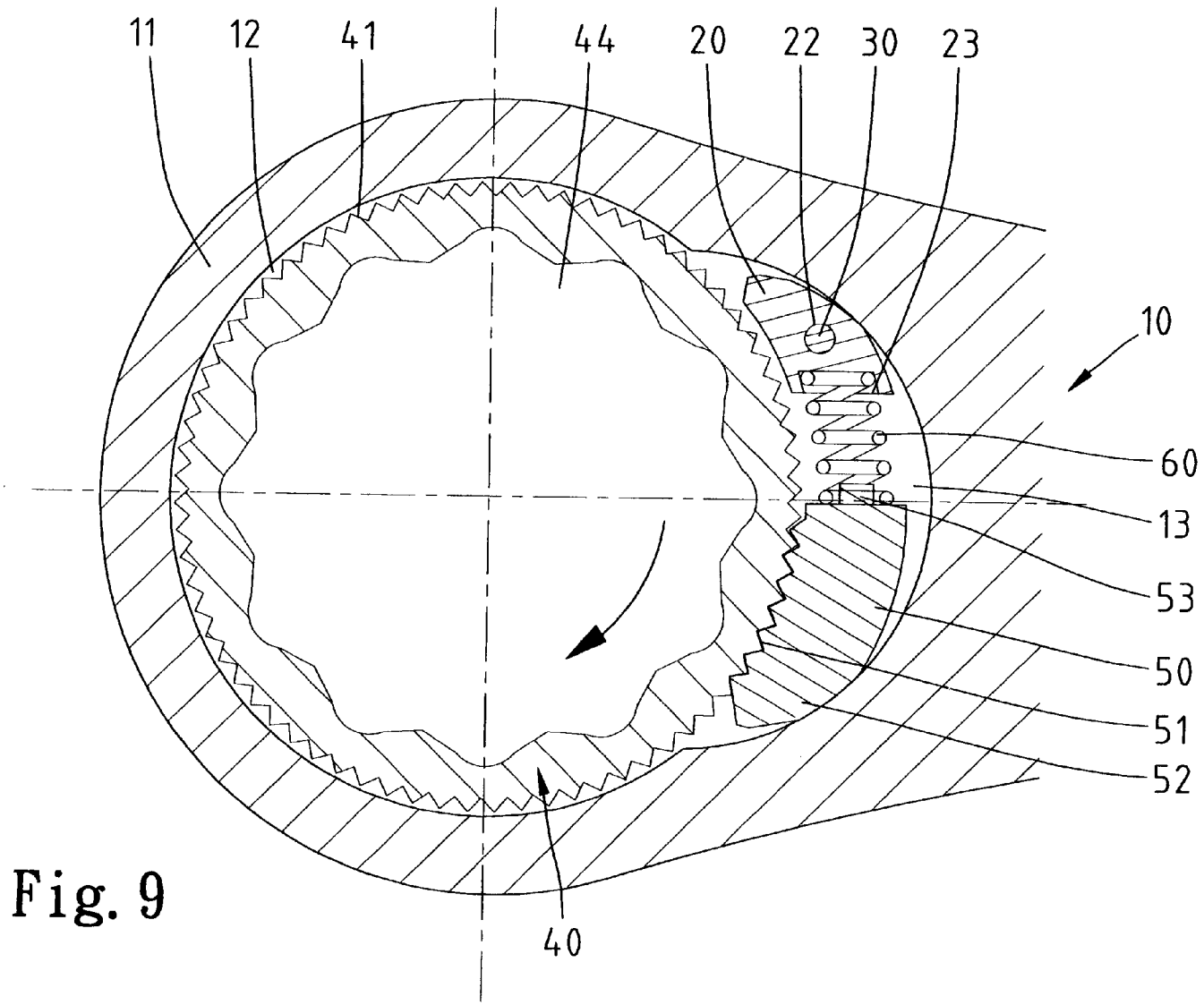
FIG. 9 is a sectional view similar to FIG. 5, illustrating another modified embodiment of the ratcheting wrench in accordance with the present invention.
Figure 10:
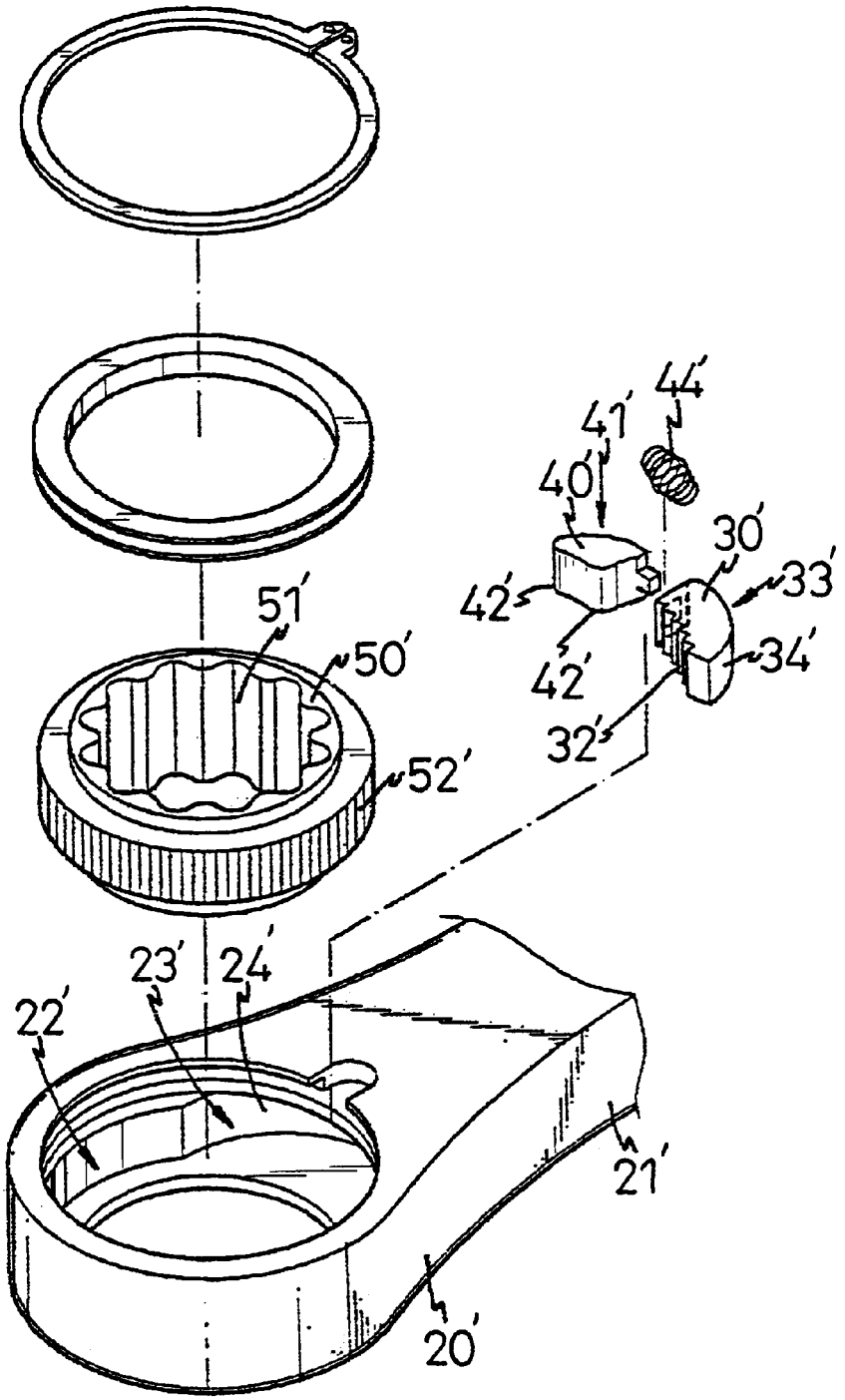
Fig. 10 PRIOR ART
FIG. 10 is an exploded perspective view of an end portion of a conventional ratcheting wrench with stuck prevention.
Figure 11:
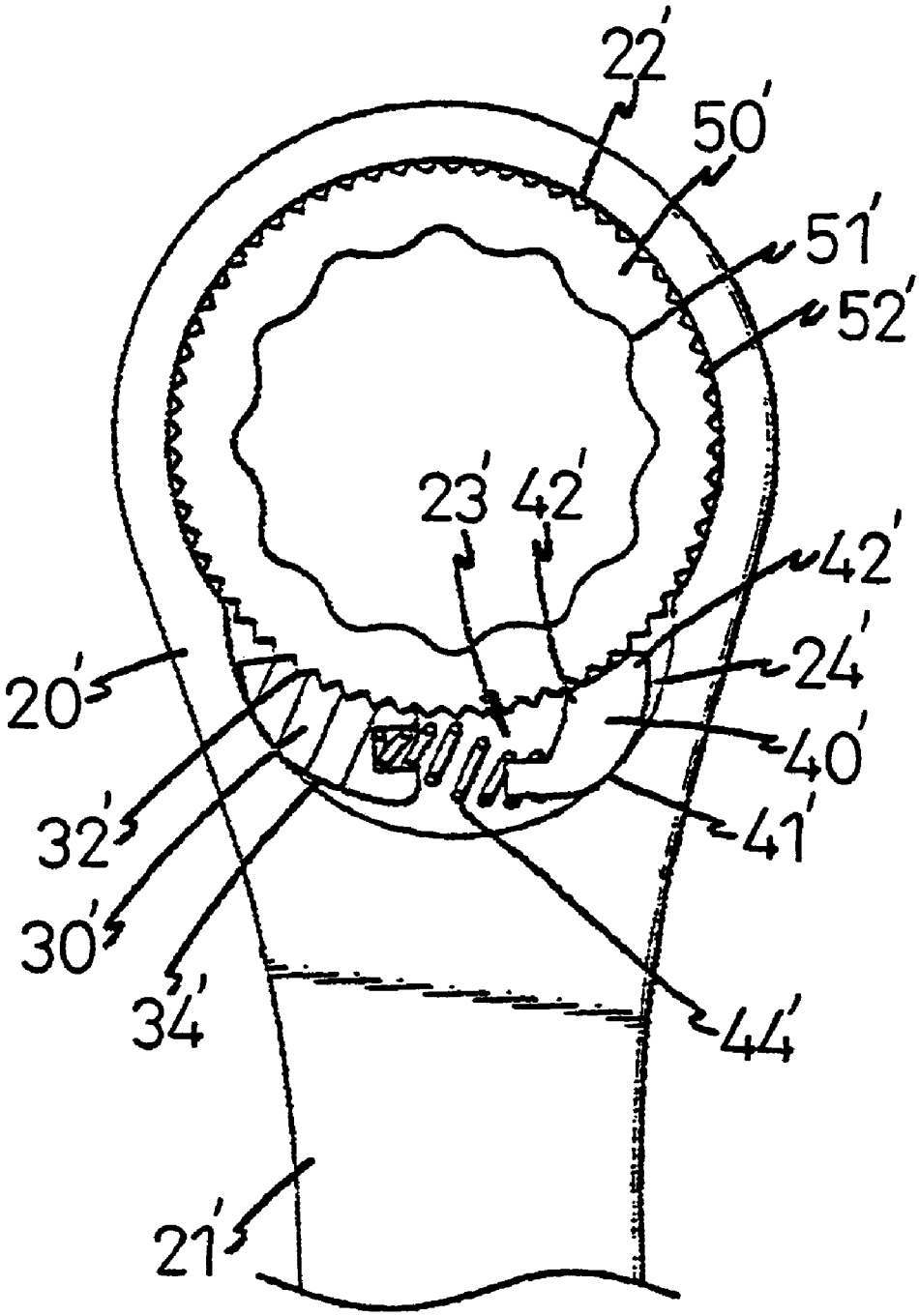
Fig. 11 PRIOR ART
FIG. 11 is a sectional view of the end portion of the conventional ratcheting wrench in FIG. 10.

FIG. 9 illustrates another modified embodiment of the invention, wherein the peg 21 of the block 20 in the first embodiment is replaced with a receptacle 23 for receiving an end of the elastic element 60.

According to the above description, it is appreciated that the wrench in accordance with the present invention provides a stuck prevention function and indicates the ratcheting direction.

Although the invention has been explained in relation to its preferred embodiment, it is to be understood that many other possible modifications and variations can be made without departing from the scope of the invention as hereinafter claimed.

What is claimed is:

1. A ratcheting wrench comprising:

a handle comprising a first side, a second side, and a cavity between the first side and the second side, a transverse hole being defined in the first side of the handle and communicated with the cavity;

a head extending from the handle and comprising a hole communicated with the cavity;

a drive member rotatably mounted in the hole of the head and comprising a plurality of teeth in an outer periphery thereof;

a block mounted in the cavity of the handle;

a fixing member extending through the transverse hole of the handle and retaining the block in the cavity;

a pawl mounted in the cavity of the handle and comprising a first side having a plurality of teeth and a second side; and means attached between the block and the pawl for biasing the teeth of the pawl to engage with the teeth of the drive member and for biasing the second side of the pawl to press against a wall defining the cavity of the handle.

2. The wrench as claimed in claim 1, wherein the transverse hole does not extend through the second side of the handle and provides an indication of a ratcheting direction of the wrench.

3. The wrench as claimed in claim 1, wherein the transverse hole extends through the second side of the handle and is not located in a longitudinal axis of the handle to thereby provide an indication of a ratcheting direction of the wrench.

4. The wrench as claimed in claim 1, wherein the fixing member is a pin having an embossed section that is in frictional engagement with an inner periphery defining the transverse hole of the handle.

5. The wrench as claimed in claim 2, wherein the fixing member is a pin having an embossed section that is in frictional engagement with an inner periphery defining the transverse hole of the handle.

6. The wrench as claimed in claim 3, wherein the fixing member is a pin having an embossed section that is in frictional engagement with an inner periphery defining the transverse hole of the handle.

7. The wrench as claimed in claim 1, wherein the drive member comprises an annular groove, an inner periphery defining the hole of the head comprising an annular groove, further comprising a C-clip received in the annular groove of the drive member and the annular groove of the head.

8. The wrench as claimed in claim 1, wherein an inner periphery defining the hole of the head comprises an annular ledge, the drive member comprising a recessed portion for engaging with the annular ledge of the head.

9. The wrench as claimed in claim 1, wherein the block comprises a peg, the pawl comprising a peg, the biasing means being an elastic element attached between the peg of the block and the peg of the pawl.

10. The wrench as claimed in claim 1, wherein the block comprises a receptacle, the pawl comprising a peg, the biasing means being an elastic element having a first end received in the receptacle of the block and a second end attached to the peg of the pawl.

11. The wrench as claimed in claim 1, wherein when the teeth of the pawl are stuck to the teeth of the drive member, free rotation of the drive member causes the pawl to impinge the block to thereby disengage the pawl from the drive member.

12. The wrench as claimed in claim 2, wherein when the teeth of the pawl are stuck to the teeth of the drive member, free rotation of the drive member causes the pawl to impinge the block to thereby disengage the pawl from the drive member.

13. The wrench as claimed in claim 3, wherein when the teeth of the pawl are stuck to the teeth of the drive member, free rotation of the drive member causes the pawl to impinge the block to thereby disengage the pawl from the drive member.

14. The wrench as claimed in claim 4, wherein when the teeth of the pawl are stuck to the teeth of the drive member, free rotation of the drive member causes the pawl to impinge the block to thereby disengage the pawl from the drive member.

15. The wrench as claimed in claim 5, wherein when the teeth of the pawl are stuck to the teeth of the drive member, free rotation of the drive member causes the pawl to impinge the block to thereby disengage the pawl from the drive member.

16. The wrench as claimed in claim 6, wherein when the teeth of the pawl are stuck to the teeth of the drive member, free rotation of the drive member causes the pawl to impinge the block to thereby disengage the pawl from the drive member.

17. The wrench as claimed in claim 7, wherein when the teeth of the pawl are stuck to the teeth of the drive member, free rotation of the drive member causes the pawl to impinge the block to thereby disengage the pawl from the drive member.

18. The wrench as claimed in claim 8, wherein when the teeth of the pawl are stuck to the teeth of the drive member, free rotation of the drive member causes the pawl to impinge the block to thereby disengage the pawl from the drive member.

19. The wrench as claimed in claim 9, wherein when the teeth of the pawl are stuck to the teeth of the drive member, free rotation of the drive member causes the pawl to impinge the block to thereby disengage the pawl from the drive member.

20. The wrench as claimed in claim 1, wherein the block has a vertical hole through which the fixing member extends.

* * * * *